United States Patent [19]

Parker

[11] Patent Number: 4,589,307

[45] Date of Patent: May 20, 1986

[54] PUSH BUTTON REVERSIBLE RATCHET WRENCH

[75] Inventor: David L. Parker, Amado, Ariz.

[73] Assignee: Bob Barber, Jr., Tucson, Ariz. ; a part interest

[21] Appl. No.: 650,259

[22] Filed: Sep. 13, 1984

[51] Int. Cl.[4] ..... B25B 13/46

[52] U.S. Cl. ..... 81/62

[58] Field of Search ..... 81/62, 63, 63.1, 63.2; 192/43.1, 47

[56] References Cited

U.S. PATENT DOCUMENTS

| | | | |
|---|---|---|---|
| 4,259,883 | 4/1981 | Carlson | 81/62 |
| 4,277,989 | 7/1981 | Tracy | 81/62 |
| 4,300,413 | 11/1981 | Garofalo | 81/62 |
| 4,308,769 | 1/1982 | Rantamen | 81/63 |
| 4,336,728 | 6/1982 | Deibert | 81/62 |
| 4,445,404 | 5/1984 | Parker | 81/62 |

*Primary Examiner*—James L. Jones, Jr.

*Attorney, Agent, or Firm*—J. Michael McClanahan

[57] ABSTRACT

A new improved push button reversible ratchet wrench completely operable by one hand having the push button improvement operably attached to a double-ended pivotal pawl engaging the ratchet wheel having the square shaped stud adapted to receive a socket. The improvement includes a cam connected at one end to the push button located transversely through the shank of the wrench mid-section. The other end of the cam is pivotally attached to an extension control rod which in turn attaches to the double-ended pawl which engages the ratchet wheel. The push button is operated simultaneously with grasping of the handle of the reversible wrench by the operator whereby manipulation of one hand, the direction in which the wrench will ratchet may be selected, or reversed or central neutral position where the pawl does not engage the ratchet wheel, may be chosen in accordance with the needs of the mechanic. In an alternate embodiment, a pivotable lever control arm is operably connected between the double-ended pawl and the transversely situated push button which operates the double-ended pawl to engage or disengage the ratchet wheel or find a neutral position.

11 Claims, 3 Drawing Figures

PUSH BUTTON REVERSIBLE RATCHET WRENCH

BACKGROUND OF THE INVENTION

Reversible ratchet wrenches have long been known in the art and are very familiar to automobile mechanics and other operators who have need to work with mechanical machinery. Since the first reversible ratchet wrench was invented, numerous improvements have heen made for accomplishing the reversing function of the ratchet wrench such as shown in the patents to J. S. Dodge, U.S. Pat. Nos. 2,003,346 and 2,590,587, as well as to Garofalo and Tracy, U.S. Pat. Nos. 4,300,413 and 4,277,989, respectively. The first patents to Dodge disclose reversible ratchet wrenches wherein two ratchet wheel engaging pawls are utilized on opposite sides of the ratchet wheel, one or the other to engage the wheel depending upon choice of rotation direction. The latter two patents to Garofalo and Tracy utilize a double-ended pawl which is maneuvered against the ratchet wheel by manual manipulation of a control rod connected to the pawl.

In addition, Applicant was previously awarded U.S. Pat. No. 4,445,404 for a reversible ratchet wrench employing a reversing push button with an attached ramp with which a control or extension rod co-acts, the other end of which is attached to the double-ended pawl. For selecting ratchet direction, the push button is depressed which causes the attached ramp to push the extension rod linearly and thus rotate the pawl into engagement with the ratchet wheel. A spring engaging the extension rod causes the extension rod to pivot the double-ended pawl to the opposite side of the ratchet wheel when the ramp is removed. Applicant's prior invention suffers fom the problem that the end of the extension rod engaging the ramp attached to the push button has a tendency to stick and catch when being operated. The application of lubricant improves the operation of the reversible wrench, however, as the lubricant is worn off, or washed away, the wrench tends to return to its prior condition of sticking or catching such as to make manipulation of the push button rather hard and difficult at times.

The desirability of a push button operated reversible mechanism near the handle of a ratchet wrench is obvious since the operator or mechanic, in grasping the handle and without removing his hand or moving his hand and utilizing his thumb or forefinger, may reverse the direction of the ratchet wrench. However, there is need for a push button type reversible ratchet wrench that provides reliable reversing action where potential problems of the mechanism hanging up or catching is avoided.

SUMMARY OF THE INVENTION

The present invention provides a unique push button type reversible ratchet wrench wherein improved embodiments are provided to conveniently reverse the ratchet direction of the wrench by means of a pawl reversing mechanism accessible as a push button to the same hand of the operator or mechanic that simultaneously grips the handle of the ratchet wrench.

In accordance with the invention, the pawl reversing mechanism which reverses the direction of the ratchet wrench utilizes a push button located in the mid-section shank of the wrench immediately above the handle portion. In this regard the push button mechanism operably pivots one end of a right angle cam, the other end of which is pivotally connected to an extension control rod which tunnels through the mid-section shank of the reversible wrench to attach pivotally to one side of the pivotable ratchet wrench direction reversing double-ended pawl. More specifically, one end of the right angle cam resides in a groove cut across the shaft which forms the push button. As the push button is pushed from one side of the mid-section shank to the other, the end of the right angle cam is moved forward or backward. This action is communicated to the extension control rod which operates the double-ended pawl.

Relative position of the push button protruding transversely through both sides of the mid-section shank indicates the position of the direction reversing pawl to inform the operator at a glance whether the ratchet is operating in the clockwise, counter clockwise, or neutral position.

In an alternate embodiment of the invention, the right angle cam and extension control rod is replaced by a single lever control arm pivotally attached at one end to the push button shaft and at the other end to the double-ended pawl, the lever control arm in turn pivoting about a fulcrum located between the push button and the double-extended pawl. Movement of the push button shaft pivots one end of the lever control arm about its fulcrum which in turn pivots the double-ended pawl about its pivotal point, engaging, disengaging, or re-engaging the double-ended pawl with the ratchet wheel, thus changing its direction. The push button may also be located in a neutral position. As before, the push button is slidably situated in a transverse opening through the mid-section shank of the wrench and operates the same as the push button of the preferred embodiment as far as the mechanic or other user is concerned.

Accordingly, it is an object of the present invention to provide a means by which an operator may change the direction, or select a neutral position, of a reversible ratchet wrench with the same hand holding the handle of the ratchet wrench and without removing or altering the grip on the wrench so held.

It is another object of the subject invention to provide a reversible ratchet wrench where the ratchet direction changing means is an improved push button mechanism accessible to the hand of the operator holding the ratchet wrench.

Still further, it is an object of the subject invention to provide a push button reversible ratchet wrench wherein the means to reverse direction of the wrench are accessible to an operators's thumb or forefinger of the hand holding the handle of the ratchet wrench.

Other objects of the invention will in part be obvious and will in part appear hereinafter. The invention accordingly comprises the apparatus possessing construction, combination of elements, and arrangement of parts which are exemplified in the following detailed disclosure, and the scope of the application of which will be indicated in the Claims.

BRIEF DESCRIPTION OF THE DRAWINGS

For further understanding of the nature and objects of the present invention, reference should be had to the following detailed description taken in connection with he accompanying drawings wherein.

In the various views, like index numbers refer to like elements.

DETAILED DESCRIPTION OF THE PREFERRED EMBODIMENT

Figure 1:
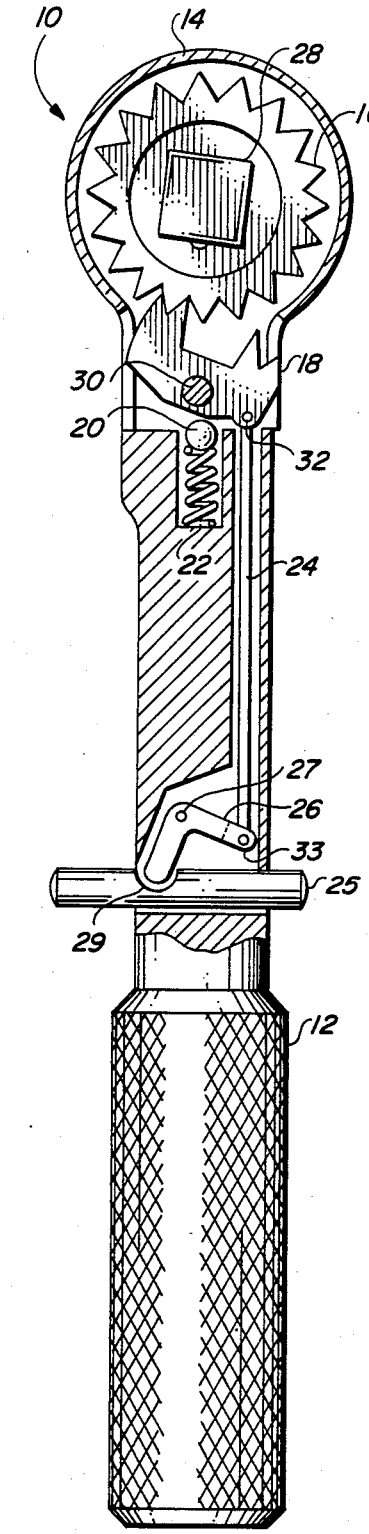
FIG. 1 is a front view of the subject invention with the ratchet reversing mechanism exposed.

Referring now to FIG. 1, a front or top view of the subject inventive push button reversible ratchet wrench 10 is shown. In the view shown, the top of the case covering the ratchet wheel has been removed for ready visibility of the functioning parts of the subject invention at that end including the portions of the invention in the mid-section shank portion of the wrench. Describing firstly the top-most portion of the push button reversible ratchet wrench 10, the upper socket receiving part 14 houses circular ratchet rotatable wheel 16 with its centrally located square sided socket receiving stud 28. Engaging ratchet wheel 16 is double-ended pawl 18 which is permitted to pivot about centrally located axle 30. Pivotally connected to one side of double-ended pawl 18 is extension control rod 24 which extends interiorly the mid-section shank of ratchet wrench 10 to the push button mechanism discribed hereinafter. Engaging the lower portion of double-ended pawl 18 is ball bearing 20 which is urged against pawl 18 by compression spring 22.

Double-ended pawl 18 is so situated that one of three pivotal positions may be selected by the operator or mechanic depending on the rotational direction the ratchet is to permit movement or whether a neutral position is chosen. Firstly, the pawl may be placed in the position shown in FIG. 1 which permits free rotation of the ratchet wheel in the clockwise direction since the tooth of the ratchet wheel, in turning clockwise, would push double-ended pawl 18 slightly downward and thereby allow the engaged tooth of the ratchet wheel to pass out of the two teeth of the pawl. However, should an attempt be made to rotate ratcher wheel 16 in a counter clockwise direction, the tooth of the ratchet wheel presently engaged by double-ended pawl 18 pulls pawl 18 into a tighter locked position against the ratchet wheel tooth and thereby inhibits rotation in that direction. Similarily, double-ended pawl 18 may be rotated counter clockwise from the position shown in FIG. 1 to a position where the pawl's right handed pair of teeth will engage a tooth of ratchet wheel 16, and in which case, rotation only in the counter clockwise direction would occur, the ratchet wheel locked into position inhibiting clockwise rotation.

Thirdly, double-ended pawl 18 may be rotated to a central position where neither teeth on either end of pawl 18 are engaging ratchet wheel 16 teeth and in which case, ratchet wheel 16 will rotate freely in either direction.

Noted immediately below double-ended pawl 18 is ball bearing 20 shown capable of engaging pawl 18 on either side or along a center position. As can be seen in FIG. 1, ball bearing 20 rests on one flattened side when that side's pair of teeth are disengaged from ratchet wheel 16. Similarily, rotation of pawl 18 to the other side causing the previously non-engaged teeth to engage a tooth of ratchet wheel 16 places the opposite flattened side of pawl 18 in contact with ball bearing 20. If the pawl 18 is situated horizontally, i.e., where neither set of teeth engage ratchet wheel 16, ball bearing 20 then will engage the centrally located flat side of pawl 18.

The purpose of engaging pawl 18 with spring loaded ball bearing 20 is to maintain the pawl in a fixed engaged or non-engaged position in order that shaking or jarring of the wrench will not cause the pawl to rotate and thus move from its engagement of ratchet wheel 16 teeth. Only through a deliberate motion or act of the operator by manipulating the push button later described is pawl 18 to change position.

Moving now down from the top portion of the wrench 10 to the lower mid-section shank of the wrench, the inventive feature of Applicant's device for selection of direction of rotation of ratchet wheel 16 is shown. As detailed above, extension control rod 24 pivotally engages one end of double-ended pawl 18 to effect pivotal rotation of pawl 18 about centrally located axle 30. Extension control rod 24 continues through a passageway in the mid-section shank portion of wrench 10 from pawl 18 in the upper portion to a pivotal connection with one end of right angle cam 26. Right angle cam 26, which itself pivots about a pivot pin 27, also engages push button 25. The second of the two ends of right angle cam 26 engages a groove which has been cut transversely across the shaft of push button 25. With the one end member of cam 26 situated within the groove cut in the shaft of push button 25, lengthwise movement of push button 25 will cause rotation of cam 26 about pivot pin 27.

Accordingly, rotation of right angle cam 26 causes longitudinal movement of extension control rod 24 connected between right angle cam 26 and pawl 18, which in turn results in rotational movement of double-ended pawl 18 to engage the teeth of ratchet wheel 16, to disengage the teeth of ratchet wheel 16 or move to a neutral position as the operator may select.

Right angle cam 26 is so configured that one end will always reside in transverse groove 29 cut into the shaft of push button 25. The shaft of push button 25 slidably resides in a rounded opening cut transversely throught the mid-section shank of wrench 10. It is intended that push button 25 should move in this transverse opening in a rather easily slidable relationship which may be enhanced from time to time with a drop of lubricating oil to maintain freedom of movement.

Thus it is apparent that by transverse movement of push button 25 through the mid-section of wrench 10, the relative position of extension control rod 24 may be varied up or down the wrench, carrying with it pawl 18, whereby selection of free rotatable, or fixed position of ratchet wheel 16 is accomplished.

It is noted that since no requirements have been placed upon the length of radius arm of right angle cam 26 which connects with extension rod 24 nor upon the distance between centrally located axle 30 and extension control rod 24, it is suggested that the pins which are held in place by right angle cam 26 and double-ended pawl 18 should be undersized with respect to the holes at opposite ends of extension control rod 24 through which the pins pass to effect the pivotal action. By this technique, the mechanism will not tend to hand up during the relatively short rotational movement of the cam and double-ended pawl. It is also obvious that the groove cut into the shaft of push button 25 must be sufficiently deep enough to accomodate the end of right angle cam 26 without touching bottom as the push button is operated.

Continuing on to the lower-most portion of push button reversible ratchet wrench 10, the mid-section shank of the wrench continues into the bottom handle 12 which the operator or mechanic grasps when working the tool. For convenience, the handle 12 has been knurled in order to provide non-slip characteristics in the mechanic's hand.

To operate the subject invention, the mechanic, in grasping handle 12, will curl his fingers about the handle having the thumb free to operate push button 25. If in the position holding the handle 12, the mechanic wishes to press the side of push button 25 opposite his thumb, the mechanic then moves his forefinger up to engage the opposite end of bush button 25 and makes the desired change of direction of ratchet wheel 16.

Figure 2:
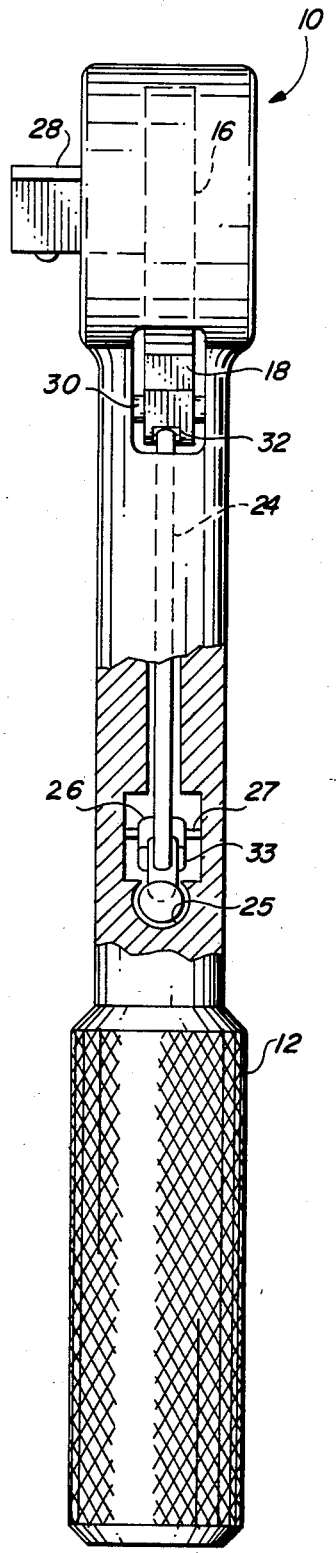
FIG. 2 is a side view of the subject invention.

Referring now to FIG. 2, a side view of the inventive push button reversible ratchet wrench 10 is detailed where a portion in the lower mid-section shank has been cut away to show a side view of the relationship of push button 25 and right angle cam 26. In this view, extension control rod 24, shown in partial dotted-partial full view, pivotally connects to pawl 18 by passing between yoke forming ears 32 on pawl 18 and there is pinned to realize the pivotal relationship. Similarily on the other end, extension control rod 24 is situated between a yoke formed in the first end of right angle cam 26, a pin passing between the ears 33 of the yoke and through a hole at the end of extension control rod 24 in order to allow the pivotal relationship needed. Holding right angle cam 26 in place in the mid-section shank of wrench 10 is pivot pin 27 shown crossing from side to side of the cavity formed in wrench 10. Emerging downward from the central portion of right angle cam 26 shown in FIG. 2 is the lower second end of right angle cam 26 which engages the transverse groove 29 cut in the shaft of push button 25. Finally, the push button 25 shaft is shown slidably residing in the rounded opening formed transversely in the mid-section shank of wrench 10. While the description above has referred to cam 26 as a right angle cam, it is obvious that this part need not take the form of a right angle, but may be of any shape compatible to the space limitation and which converts linear movement of push button 25 shaft to linear movement of extension control rod 24 where these latter two elements are situated at a 90° angle with respect to each other.

Figure 3:
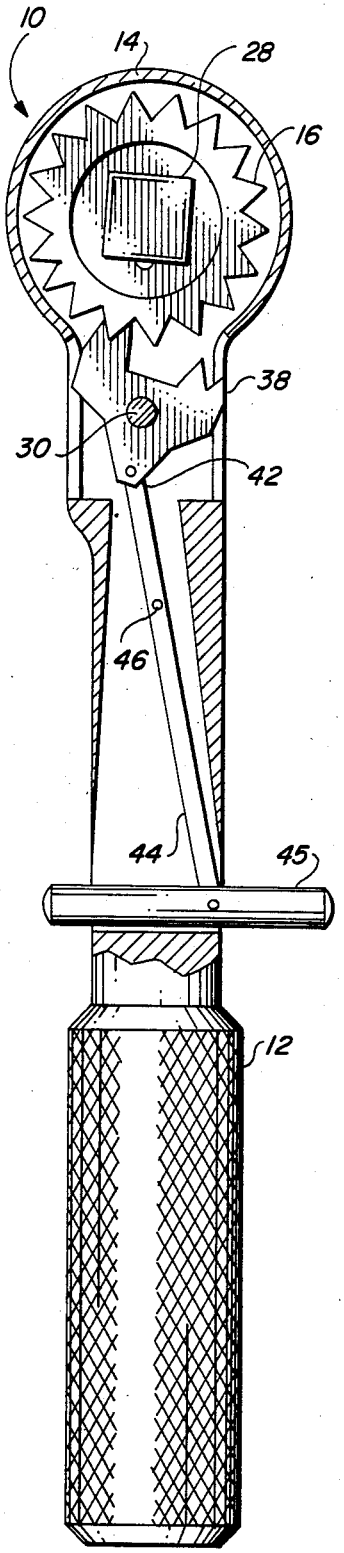
FIG. 3 is a front view of an alternate embodiment of the invention showing a second push button operated mechanism for reversing the direction of the reversible ratchet wrench.

Referring now to FIG. 3, an alternate embodiment of the subject invention is shown which similarily utilizes a push button mechanism to achieve a result of changing direction of the ratchet wheel 26, but utilizes different means to implement the results.

In FIG. 3, a front view with partial cut away of the alternate embodiment of the invention is shown. In this embodiment, lever control arm 44, pivotal about fulcrum 46, is engaged at one end by double-ended pawl 38 which had been slightly modified from the previously described double-ended pawl 18, and engaged at its other end by push button 45 which, like push button 25 of the referred embodiment, slidably resides in an opening formed transversely in the mid-section shank of the ratchet wrench 10.

Lever control arm 44 is pinned between two ears 42 formed in an extended part of pawl 38 which protrudes outward from the central axle 30. Similarily, the other end of lever control arm 44 is pinned to the shaft of push button 45 extending transversely in the mid-portion shank of the wrench. To accomodate the end of lever control arm 44 which receives the pin, a blind slot has been but lengthwise into the shaft of push button 45 to permit the pin held on both sides of the slot in the push button shaft to pass through the opening in the end of lever control arm 44. Both pins at each end of lever control arm 44 permit pivotal action between lever control arm 44 and their respective connecting piece, i.e., pawl 38 or push button 45. Also, as is the function of a fulcrum, lever control arm 44 is pivotal about the pin which forms the fulcrum 46.

As was mentioned in the case of the relationship between the size of the opening in the end of the extension control rod 24 and the diameter of the pins in the pawl 18 and cam 26 of the preferred embodiment, here again oversized openings in the lever control arm 44 or undersized pins are required in order that mechanism work properly. In fact, slots may be formed in the lever control arm.

The alternate embodiment of FIG. 3 operates similarily as does the preferred embodiment shown in FIGS. 1 and 2, namely direction of the rotational freedom or ratchet wheel 16 is reversed by moving push button 45 to various positions relative to the shank of wrench 10. In the embodiment shown in FIG. 3, the neutral position of pawl 38 schieved by utilizing the ball bearing 20 and its associated spring 22 has not been shown. It would accordingly, however, be obvious that such arrangement could be added to pawl 38 by forming the three flat surface areas as utilized in the preferred embodiment of FIG. 1 on a portion of the lower extended portion of pawl 38 immediately underneath the part which connects with lever control arm 44. The spring loaded ball bearing would then be located in the wrench shank to permit the ball to engage the three surfaces. If pawl 38 were then viewed from the side, it would have the appearance of two steps in the direction opposite the teeth. The first and longest step would encompass the ears 42, and the shorter step the three flat surface configuration shown in FIG. 1 operating together with the spring loaded ball bearing 20.

While a preferred embodiment of the invention has been shown and described, together with one alternate embodiment, it is appreciated that the scope of the invention is not to be limited except as defined in the appended claims.

I claim:

1. An improvement in reversible ratchet wrenches of the type having in its upper portion a ratchet wheel attached to a square shaped stud adapted to receive a socket, a double ended ratchet reversing pivotal pawl adapted to pivot and engage the ratchet wheel with one end or the other and thereby effect a reversal, a mid-section shank portion connecting to the upper portion, and a handle to be held by the operator's hand, said handle connecting to the mid-section portion, the improvement comprising:

a movable extension control rod having a first and second end, said first end operably attached to the pivotal pawl, a direction reversing push-button assembly penetrating transversely the mid-section shank portion proximate the handle, and a pivotal cam having a first and second end, said pivotal cam operably attached at said first end to said extension control rod second end and said pivotal cam second end engaging said push-button assembly where by pushing said push-button pivots said pivotal cam and thereby moves said extension control rod to pivot the double ended pawl to effect a reversal of the ratchet direction.

2. The improvement in reversible ratchet wrenches as defined in claim 1 wherein said push-button assembly defines an elongated rod having a groove formed transversely in said rod, said groove adapted to receive the second end of said pivotal cam.

3. The improvement in reversible ratchet wrenches as defined in claim 2 wherein said pivotal cam operably attached to said extension control rod second end is pivotally attached to said extension control rod.

4. The improvement in reversible ratchet wrenches as defined in claim 3 wherein said extension control rod first end operably attached to the double-ended pawl is pivotally attached to the double-ended pawl.

5. The improvement in reversible ratchet wrenches as defined in claim 4 wherein said extension control rod first end is pivotally attached to one end of the double-ended pivotal pawl.

6. The improvement to reversible ratchet wrenches as defined in claim 1 wherein said extension control rod defines a pivotal lever, said pivotal lever having a fulcrum situated between the said first end operably attached to the pivotal pawl and said second end operably attached to said reversing push-button assembly.

7. The improvement in reversible ratchet wrenches as defined in claim 6 wherein said push-button assembly defines an elongated rod, said elongated rod operably attached to said extension control rod second end where by pushing said push-button, said extension control rod is pivoted about its fulcrum to effect a pivoting of the double-ended pawl to reverse the ratchet direction.

8. The improvement in reversible ratchet wrenches as defined in claim 7 wherein said push-button assembly elongated rod includes a blind groove formed longitudinally in said elongated rod, said groove adapted to receive said extension control rod second end.

9. The improvement in reversible ratchet wrenches as defined in claim 8 wherein said extension control rod operably attached to said push-button assembly includes said extension control rod second end pivotally attached to said push-button assembly elongated rod within said elongated rod blind groove.

10. The improvement in reversible ratchet wrenches as defined in claim 9 wherein said extension control rod first end operably attached to a double-ended pawl is pivotally attached to the double-ended pawl.

11. The improvement in reversible ratchet wrenches as defined in claim 10 wherein said extension control rod first end pivotally attached to the double-ended pawl is pivotally attached to the double-ended pawl at a point mid-way between the ends of the pawl.

* * * * *